US011382423B2

(12) United States Patent
Allen

(10) Patent No.: US 11,382,423 B2
(45) **Date of Patent: *Jul. 12, 2022**

(54) LOCKER WITH RECLINING SEAT AND ROLL-UP DOOR

(71) Applicant: Sam Allen, Maypearl, TX (US)

(72) Inventor: Sam Allen, Maypearl, TX (US)

(73) Assignee: AIM Design, LLC, Desoto, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/515,605

(22) Filed: Jul. 18, 2019

(65) Prior Publication Data

US 2019/0365094 A1 Dec. 5, 2019

Related U.S. Application Data

(60) Provisional application No. 62/732,833, filed on Sep. 18, 2018.

(51) Int. Cl.

| | |
|---|---|
| ***A47B 61/02*** | (2006.01) |
| ***E05D 15/38*** | (2006.01) |
| ***A47B 83/00*** | (2006.01) |
| ***A47B 61/04*** | (2006.01) |
| ***F24F 7/00*** | (2021.01) |
| ***A47C 1/02*** | (2006.01) |

(52) U.S. Cl.

CPC ..... *A47B 61/02* (2013.01); *A47B 61/04* (2013.01); *A47B 83/00* (2013.01); *A47C 1/02* (2013.01); *E05D 15/38* (2013.01); *F24F 7/00* (2013.01); *E05Y 2900/212* (2013.01); *F24F 2007/001* (2013.01)

(58) Field of Classification Search

CPC ..... A47B 61/02; A47B 61/04; A47B 83/00; A47C 1/02; E05D 15/38; F24F 7/00

USPC ..... 312/235.2, 235.3, 235.4, 235.5, 235.9, 312/297, 330.1, 334.24, 334.28, 229, 294; 211/34, 35, 36

See application file for complete search history.

(56) References Cited

U.S. PATENT DOCUMENTS

| | | | | | |
|---|---|---|---|---|---|
| 429,421 | A * | 6/1890 | Coit | | |
| 1,281,923 | A * | 10/1918 | Fales | A47B 88/42 | 312/317.2 |
| 1,491,039 | A * | 4/1924 | Voina-Hansen | A47C 9/06 | 312/235.3 |
| 1,830,804 | A * | 11/1931 | Piquette | A47B 61/04 | 211/35 |
| 2,457,445 | A * | 12/1948 | Clair | A43D 3/1483 | 211/35 |
| 2,923,584 | A * | 2/1960 | Broderick, Jr. | A47B 53/00 | 312/317.1 |
| 3,222,105 | A * | 12/1965 | Cross | A61G 15/14 | 297/188.21 |
| 3,317,259 | A * | 5/1967 | Otis | E06B 9/115 | 312/297 |
| 3,353,865 | A * | 11/1967 | Bass | A47C 13/00 | 297/143 |
| 3,712,697 | A * | 1/1973 | Kelley | E06B 5/006 | 312/297 |
| 4,165,124 | A * | 8/1979 | Olan | A47B 83/00 | 297/188.03 |

(Continued)

*Primary Examiner* — James O Hansen

(74) *Attorney, Agent, or Firm* — James E. Walton

(57) ABSTRACT

A locker has a reclining seat and a roll-up door. The reclining seat has a bench, a seatback, a footrest, and a headrest. The roll-up door retracts into the interior of the locker.

10 Claims, 8 Drawing Sheets

(56) References Cited

U.S. PATENT DOCUMENTS 4,456,316 A * 6/1984 Lundgren ..... A47B 61/04 312/229
4,460,094 A * 7/1984 Schoen ..... A47G 25/005 211/35
4,512,241 A * 4/1985 Morris ..... E03D 9/04 454/245
4,699,267 A * 10/1987 Burke ..... A45C 7/00 190/13 F
5,121,974 A * 6/1992 Monson ..... A47B 21/00 160/113
5,468,063 A * 11/1995 Simonek ..... A47B 88/42 312/287
5,547,270 A * 8/1996 Dang ..... A47B 85/08 312/194
5,791,749 A * 8/1998 O'Neill ..... A47F 3/002 312/117
5,992,648 A * 11/1999 Saunders ..... A47F 7/08 211/35
6,336,691 B1 * 1/2002 Maroney ..... H05K 7/20127 312/213
6,508,525 B2 * 1/2003 Picogna ..... A47B 37/02 312/196
6,513,889 B1 * 2/2003 Park ..... A47B 81/02 312/206
6,598,948 B1 * 7/2003 Harmon ..... A47B 49/002 211/34
7,963,621 B1 * 6/2011 Ellis ..... B25H 3/04 312/242
8,714,669 B1 * 5/2014 Clausen ..... A47B 49/004 160/37
8,733,865 B1 * 5/2014 Chambers ..... A47B 88/42 312/334.24
2007/0132292 A1 * 6/2007 Robertson ..... A47C 1/0242 297/330
2007/0278914 A1 * 12/2007 Verfaillie ..... A47B 88/42 312/226
2009/0019634 A1 * 1/2009 Lipponen ..... A61H 33/6005 4/524
2010/0201230 A1 * 8/2010 Schweitzer, III ..... H02B 3/00 312/107
2014/0319984 A1 * 10/2014 Younts ..... H05K 7/20736 312/236

* cited by examiner

LOCKER WITH RECLINING SEAT AND ROLL-UP DOOR

This application claims the benefit of U.S. Provisional Application No. 62/732,833, filed 18 Sep. 2018, titled "Locker with Reclining Seat and Roll-Up Door," which is incorporated herein for all purposes.

BACKGROUND

1. Field of the Invention

The present invention relates generally to improvements in lockers or storage cabinets used in athletic or sporting facilities, and more specifically to seating integrated into such lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
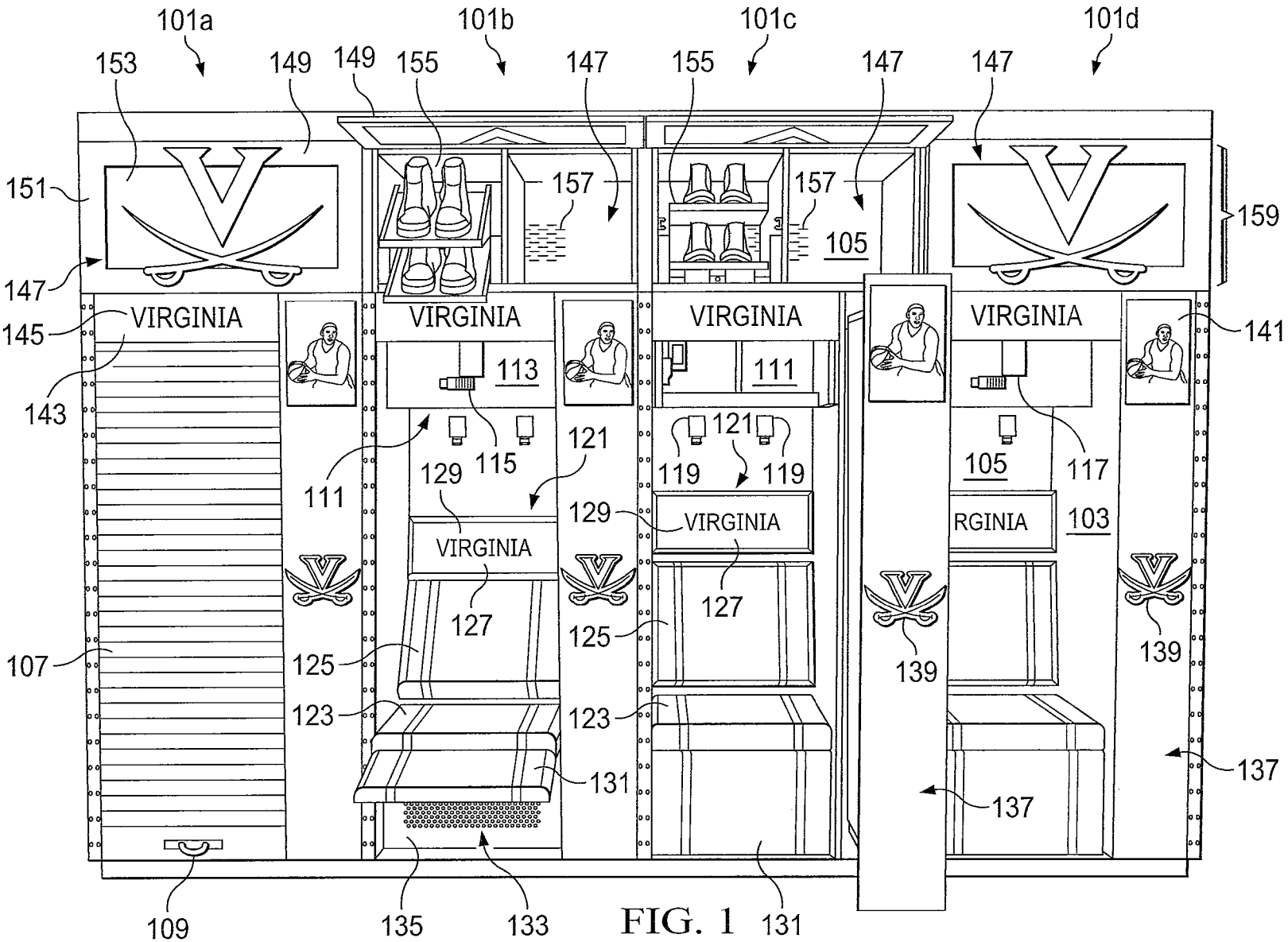
FIGS. 1 and 2 are perspective views of multiple examples of a locker according to a preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
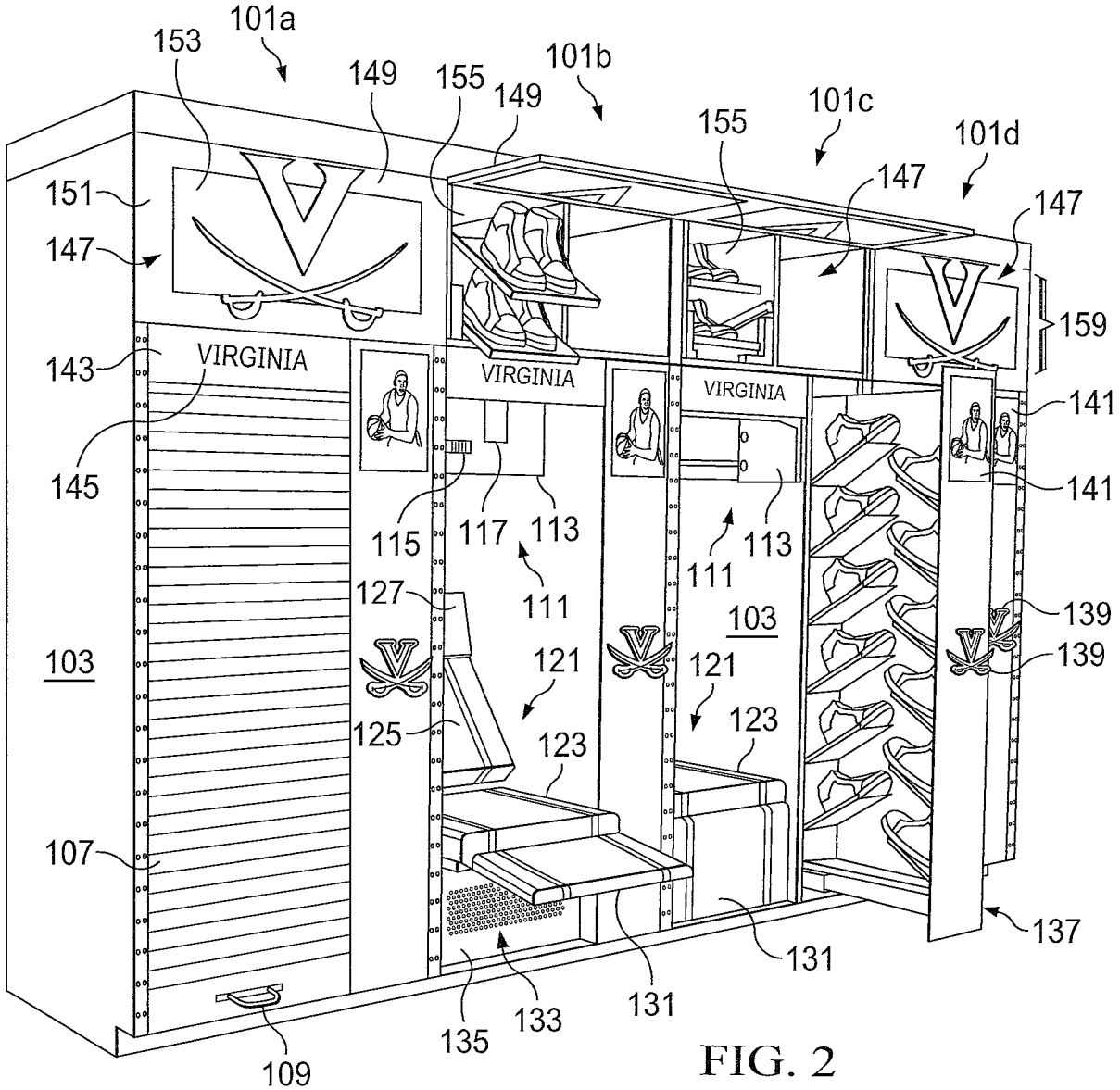

Referring now to FIGS. 1 and 2 in the drawings, lockers 101*a*, 101*b*, 101*c*, and 101*d* according to the preferred embodiment of the present application are depicted. Locker 101*a* shows a locker wherein a roll-up door 107 and an overhead door 149 are in closed positions, and a shoe storage unit or compartment 137 is in a retracted position. Locker 101*b* shows a locker wherein roll-up door 107 is in an open position, a compartment door 113 is in a closed position, a seat 121 is in a reclined position, overhead door 149 is in an open position, and a shoe shelf 155 is extended from an overhead compartment 145. Locker 101*c* shows a locker wherein roll-up door 107 in in an open position, compartment door 113 is in an open position, seat 121 is in an upright position, overhead door 149 is in an open position, and shoe shelf 155 is retracted into overhead compartment 145. Locker 101*d* shows a locker wherein doors 147 and 113 are in closed positions, seat 121 is in an upright position, shoe storage compartment 137 is in a retracted position, and roll-up door 107 is in an open position.

Referring now to FIGS. 3A-3C and 4 in the drawings, lockers 301*a*-301*c*, 401*a*-401*c* according to the preferred embodiment of the present application are depicted. Locker 301*a* is the same locker as lockers 101*a*-101*d* but further showing a preferred embodiment of door chamber 307, door-guiding component 305, and plenum 303, which are excluded from FIGS. 1 and 2 for clarity. Locker 301*a* also shows the preferred stored configuration of door 107 when the door is in an open position. Lockers 301*b*-301*c* are alternative embodiments of locker 301*a* that show two different configurations of roll-up door 107, door chamber 307, and door-guiding component 305. Lockers 401*a*-401*c* are the same lockers as lockers 101*a*-101*d*, 301*a*, but further showing control panel 403, which is excluded from FIGS. 1, 2, and 3A-3C for clarity. Lockers 401*a*-401*c* also do not show door-guiding component 305 and door 107 for clarity.

Figure 5A:
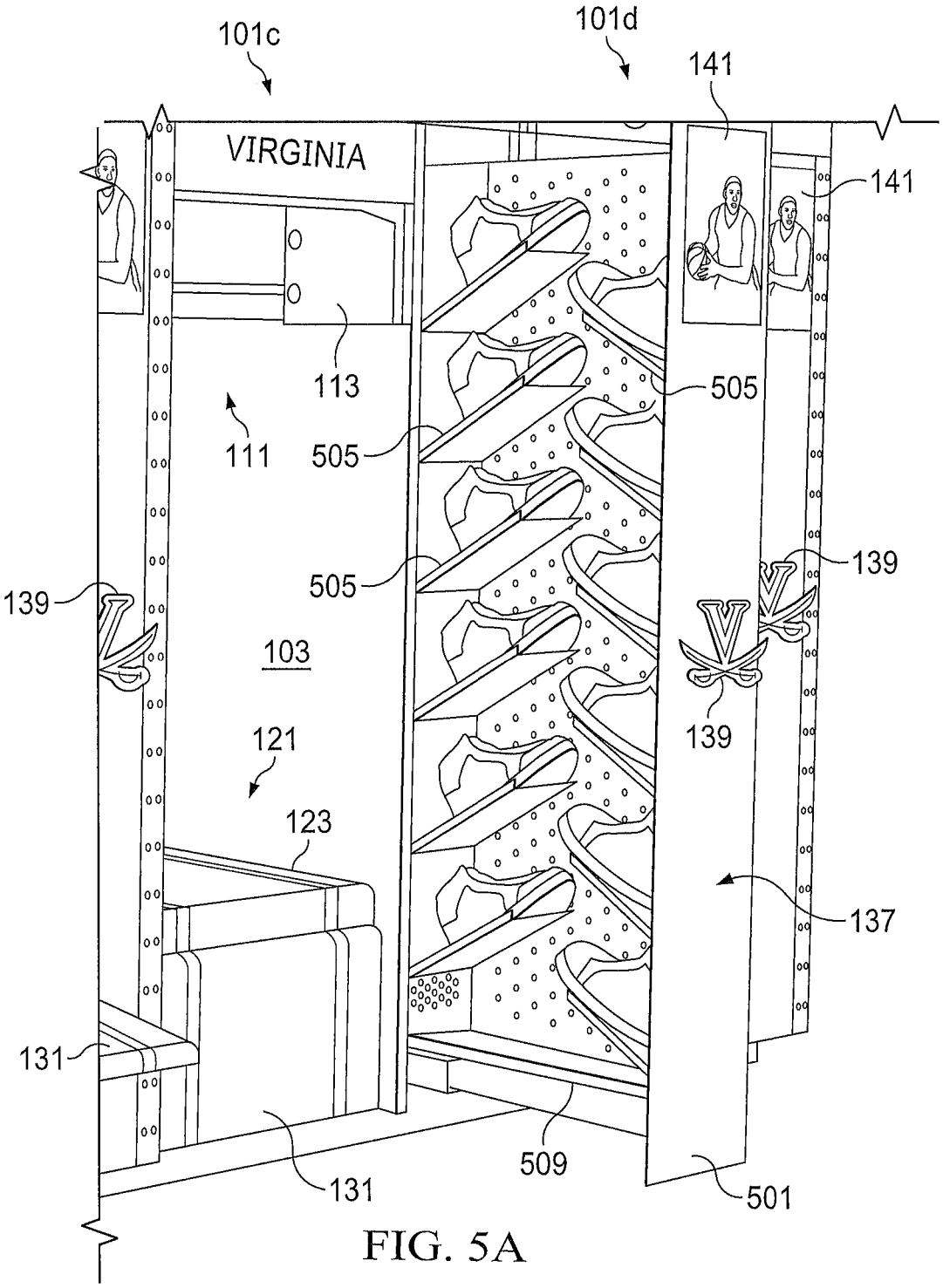
FIGS. 5A and 5B are enlarged views of a pull-out shoe drawer feature of the lockers of FIGS. 1 and 2.
Figure 5B:
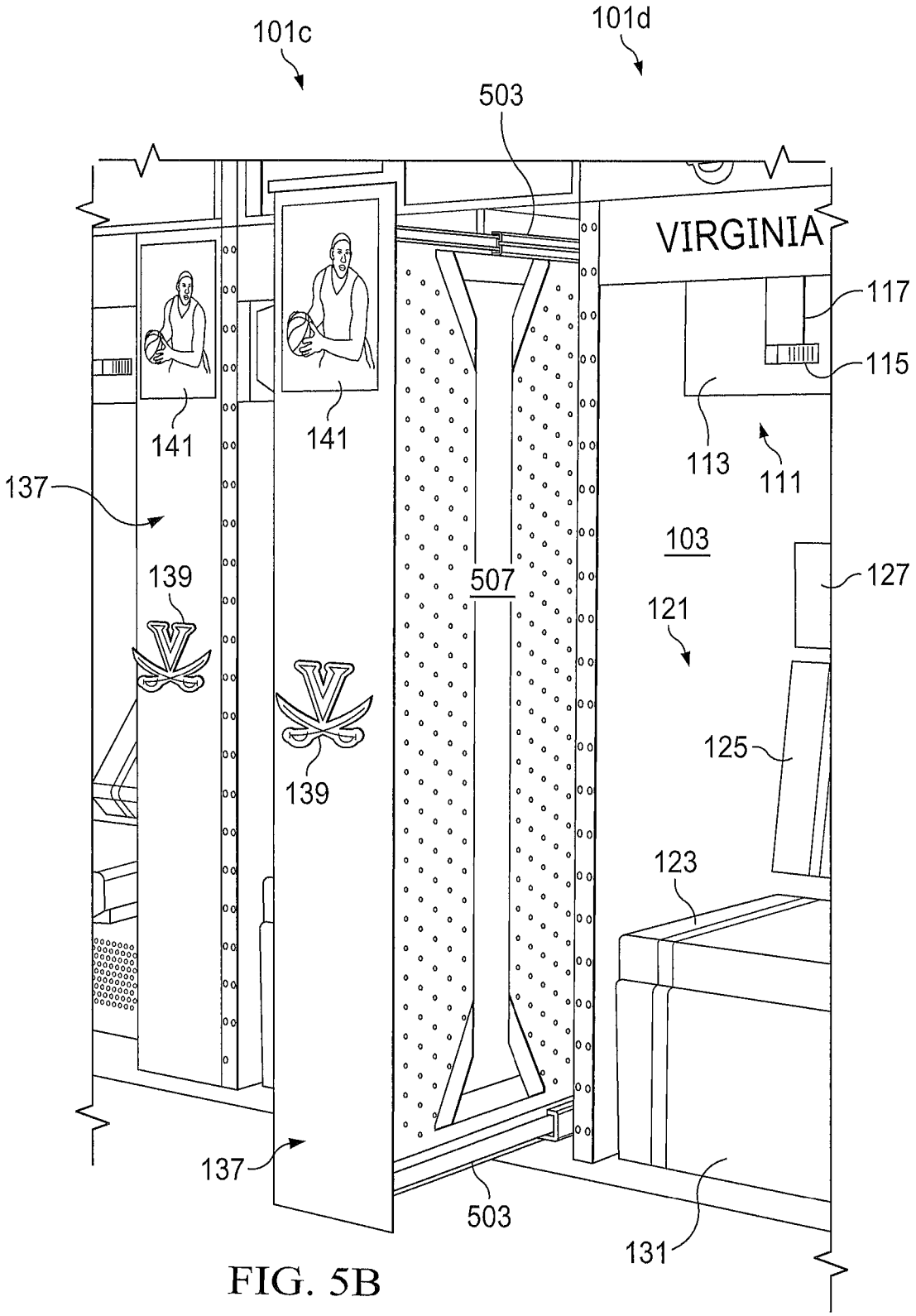

Referring now to FIGS. 5A and 5B in the drawings, lockers 101*c* and 101*d* from FIGS. 1 and 2 are shown in an enlarged view to better show shoe storage unit or compartment 137. FIG. 5A shows shoe storage compartment 137, as well as projections 505, end walls 501, and removable tray 509. FIG. 5B shows shoe storage compartment 137, as well as rear wall 507 and drawer slides 503. In the preferred embodiment, shoe storage unit 137 includes self-closing soft-close drawer slides that assist with closing shoe storage unit 137 and prevent shoe storage unit 137 from slamming closed, thereby reducing the chance that locker 101*c* and 101*d* are damaged from rough and/or abusive use.

Lockers 101*a*-101*d*, 301*a*-301*c*, 401*a*-401*c* generally comprise a pair of upstanding sidewalls 103 that generally define the extent of the locker. A back wall 105 connects sidewalls 103 at the rear of each locker 101, 301, 401 (see FIGS. 1, 3A-C, and 4). Sidewalls 103 and back walls 105 may be made various materials, including wood, laminates, polymers, metals, and composites. The material choice will depend upon the properties desired for the chosen application and embodiment of the locker. For example, lockers that will be holding dirty and wet equipment may be better suited for construction from polymer since it is durable and easy to clean, whereas lockers at a prestigious or upscale institution might be made from wood or laminate since it creates a nicer appearance. Each locker 101*a*-101*d*, 301*a*-301*c*, 401*a*-401*c* may be installed adjacent to another, similar or identical locker, with its rear against a wall, and its front facing the interior of a locker room. Each locker 101*a*-101*d*, 301*a*-301*c*, 401*a*-401*c* may also be installed behind and facing the opposite direction of another, similar or identical locker, with its rear walls against the rear wall of another locker and its front facing the interior of a locker room. Sidewalls 103 and back walls 105 may be arranged to create an interior area of the locker.

Between the sidewalls 103 of lockers 101*a*-101*d*, 301*a*-301*c*, 401*a*-401*c*, a plurality of compartments 111 are defined by shelves or other horizontally extending surfaces or platforms (see FIGS. 1-5B). As used herein, "sidewall" or "sidewalls" may refer to either "main" sidewalls 103 or other upstanding or generally vertical sidewalls arranged between the "main" sidewalls. Multiple additional sidewalls 103 may be placed between the "main" or exterior sidewalls 103 to define compartments 111 in cooperation with generally horizontally extending shelves or platforms. The sidewalls and shelves of compartments 111 may be made of the same materials of sidewalls 103 and back walls 105 of lockers 101*a*-101*d*, 301*a*-301*c*, 401*a*-401*c*, or may be made of differing materials, depending on the desired properties of the specific application and embodiment of the locker. Each compartment 111 may be sized and otherwise configured for storage of clothing or sporting equipment or other items and may include at least one door 113, which may be lockable with lock 115. Compartments 111 may further contain features such as electrical outlets or charging ports.

A plenum 303 may be mounted on the rear or exterior side of back wall 105 (see FIGS. 3A-3C and 4, not shown in FIGS. 1-2). Plenum 303 may be connected via duct work 309 to the existing HVAC 311 of the locker room or room in which lockers 101*a*-101*d*, 301*a*-301*c*, 401*a*-401*c* are disposed or situated. The HVAC 311 system to which plenum 303 is connected may be the conventional heating and cooling system of the building or room in which lockers 101*a*-101*d*, 301*a*-301*c*, 401*a*-401*c* are disposed, or may be a dedicated system for the lockers themselves. The HVAC 311 system thus provides heated, cooled, and/or dehumidified air to each locker 101*a*-101*d*, 301*a*-301*c*, 401*a*-401*c* through plenum 303.

Plenum 303 may communicate air from the HVAC 311 system to the interior and various compartments 111, 133, 137, 147 of lockers 101*a*-101*d*, 301*a*-301*c*, 401*a*-401*c* through a plurality of ventilation apertures or grilles 157 formed in back wall 105. Preferably, a grille or aperture 157 (grille is used herein to mean a single aperture or a group of apertures in any arrangement, e.g. circles, squares, other shapes, arranged in any pattern) is arranged through back wall 105 at least at an upper extent of lockers 101*a*-101*d*, 301*a*-301*c*, 401*a*-401*c* to insure a supply of air to the entirety of the locker or at least the upper compartments thereof. As illustrated, a ventilation aperture or grille 157 is located in an overhead compartment 147.

Grilles 157 may preferably be provided with a damper arrangement or mechanism that permits the partial closure or obstruction of the aperture(s) of grilles 157 to control the flow of air from plenum 303. One or more front or forward ventilation grilles may be provided in the front panels or surfaces (forward of back wall 105 and generally between side walls 103) of lockers 101*a*-101*d*, 301*a*-301*c*, 401*a*-401*c* to permit exhaust or intake of air from or to the locker. Alternatively the natural gaps left between doors and openings in lockers 101*a*-101*d*, 301*a*-301*c*, 401*a*-401*c* can provide the exhaust or intake of air. Grilles 157 and their dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Thus, airflow may be established through lockers 101*a*-101*d*, 301*a*-301*c*, 401*a*-401*c* from plenum 303, through ventilation grille 157, and out of lockers 101*a*-101*d*, 301*a*-301*c*, 401*a*-401*c* through other grilles or other openings in the front or forward portions of locker. Alternatively, air circulated through the locker may be exhausted through a duct 309 or conduit to an area remote from lockers 101*a*-101*d*, 301*a*-301*c*, 401*a*-401*c* and/or the locker room or building in which they are located. Ventilation may be assisted by one or more circulation fans located in lockers 101*a*-101*d*, 301*a*-301*c*, 401*a*-401*c* (not shown). Some embodiments of lockers 101*a*-101*d*, 301*a*-301*c*, 401*a*-401*c* may contain equipment drying fixtures such as glove dryers or shoe dryers. Some embodiments of lockers 101*a*-101*d*, 301*a*-301*c*, 401*a*-401*c* may include components to enable ventilation in a seat assembly.

The interior area of the lockers 101*a*-101*d*, 301*a*-301*c*, 401*a*-401*c* may be closed and secured by a roll-up door 107 that slides between sidewalls 103. Roll-up door 107, in a preferred embodiment, is a roll-type door comprising a single panel made of segments of aluminum, but may be made with varying designs and materials depending on the desired properties and application of the lockers 101*a*-101*d*, 301*a*-301*c*, 401*a*-401*c* and door 107. For example, in the embodiment seen in FIG. 3C, door 107 is made of two distinct segmented aluminum panels that retract into and behind locker 301*c* in opposite directions.

Figure 3A:
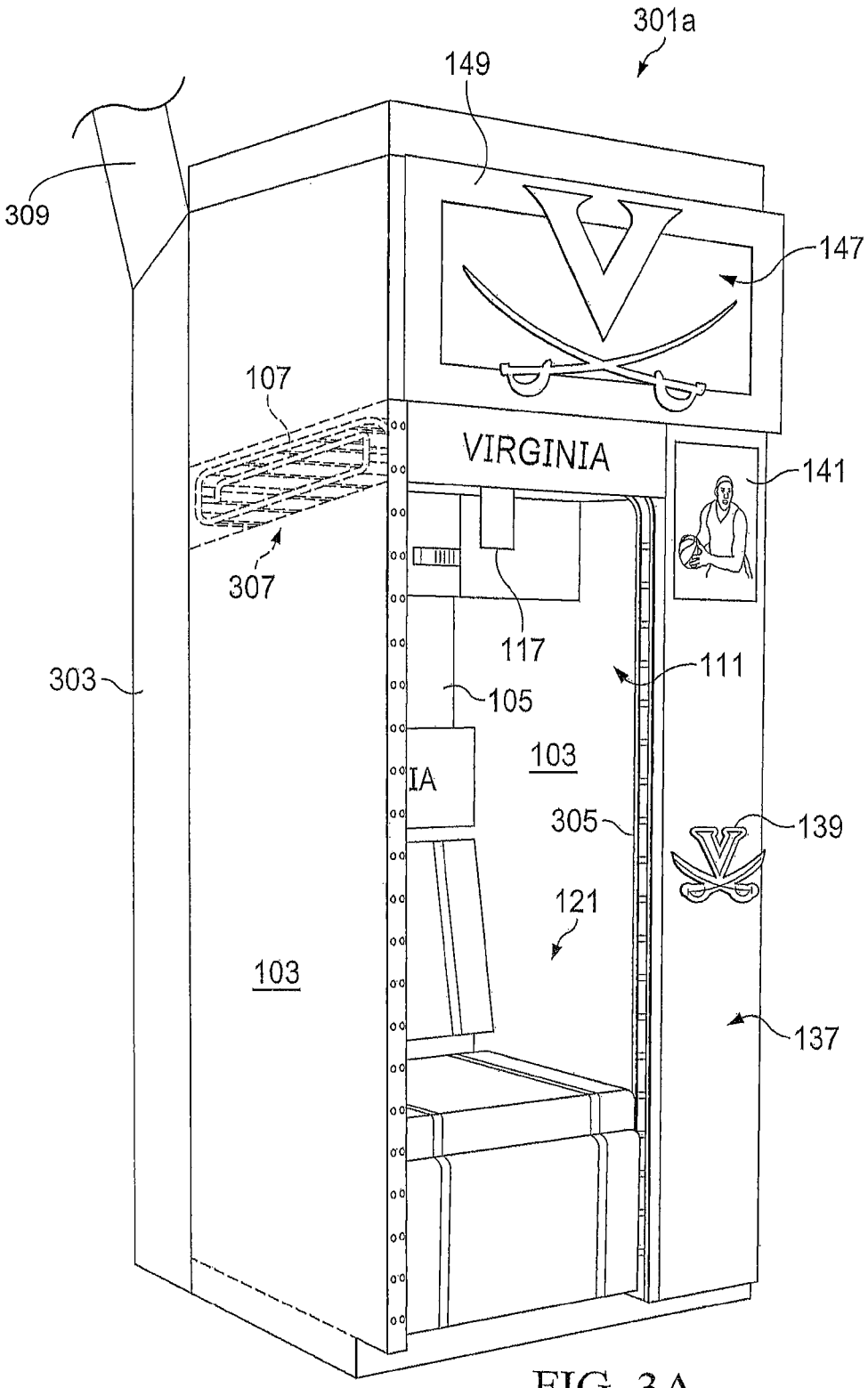
FIGS. 3A-3C are perspective views of the lockers of FIGS. 1 and 2 with the doors shown in an open position, and the seats shown in an upright position.
Figure 3B:
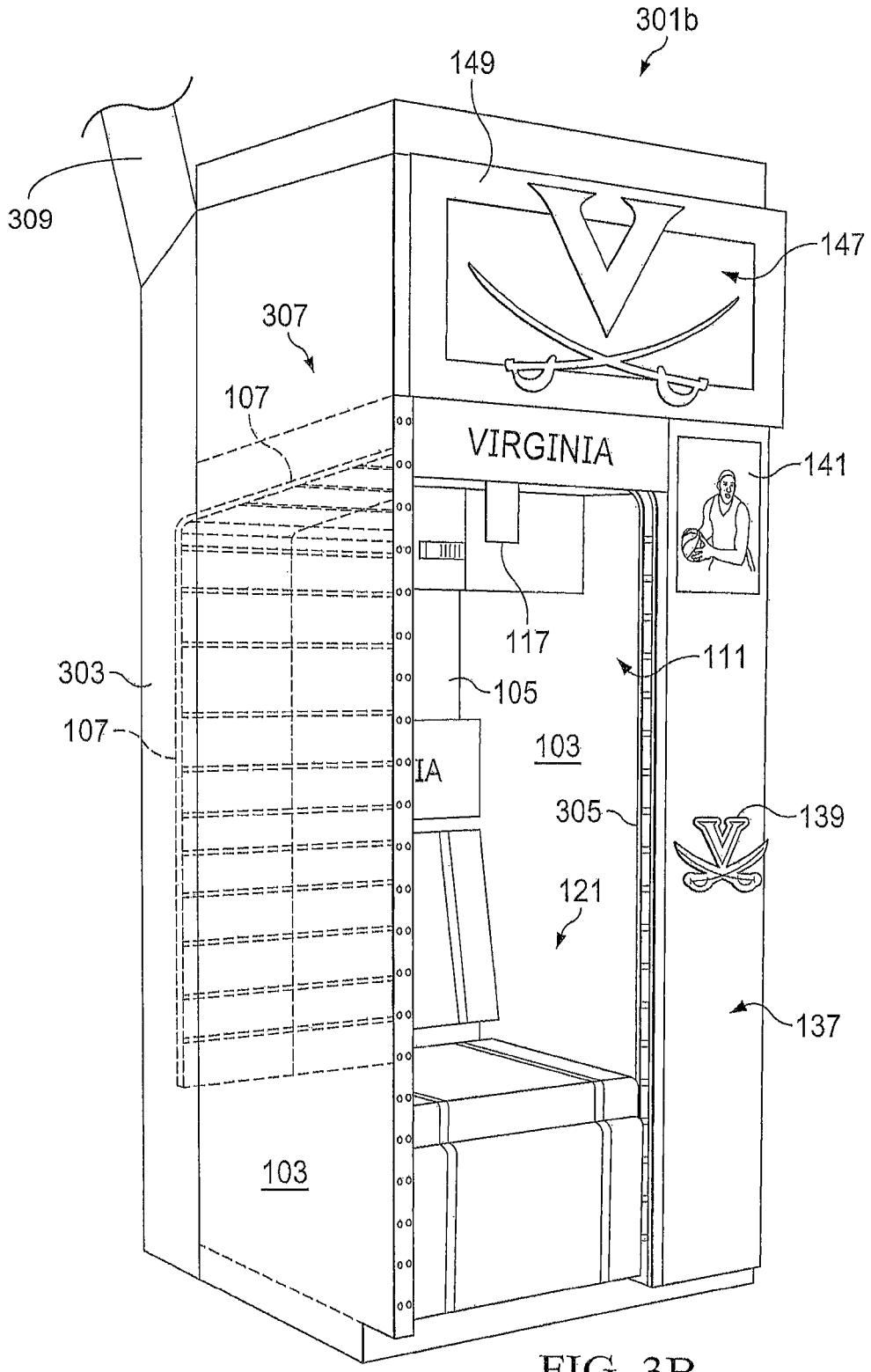
Figure 3C:
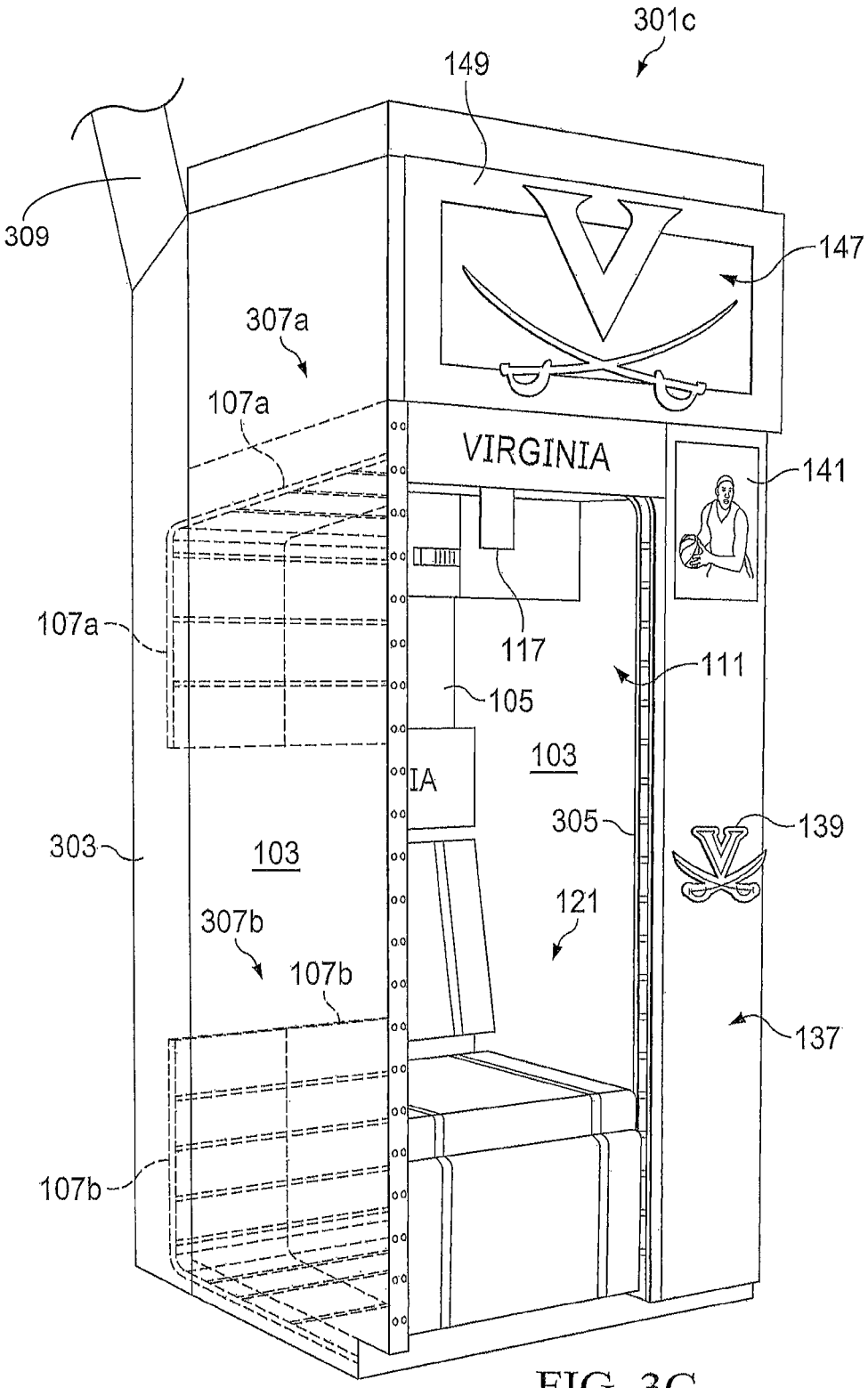

The placement and the direction of roll-up door 107 is defined by door guiding components 305 (see FIGS. 3A-3C). The door guiding components 305 preferably comprise systems commonly used to guide roll-up or sliding type doors, such as the track or slide systems typically found on garage or loading bay doors. Other embodiments of lockers 101*a*-101*d*, 301*a*-301*c*, 401*a*-401*c* may utilize guiding components 305 comprising various other parts or systems, depending on the design of the lockers. As illustrated, components 305 are shown as only being present on the right sidewall of the interior area of lockers 101*a*-101*d*, 301*a*-301*c*, 401*a*-401*c*, but in the preferred embodiment components 305 are present on both sides of the interior area so that door 107 is supported along both sides.

When roll-up door 107 is opened, the door retracts into a door chamber 307. In the preferred embodiment, chamber 307 is a contained opening (see FIG. 3A) wherein door 107 winds into a coiled arrangement. The preferred embodiment as depicted in FIG. 3A shows door 107 wound into a generally oval-shaped coil arrangement, but door 107 may be stored in multiple arrangements, such as various wound coil arrangements, arrangements wherein door 107 is layered but not coiled, or arrangements where door 107 is stored in a single layer.

Figure 4:
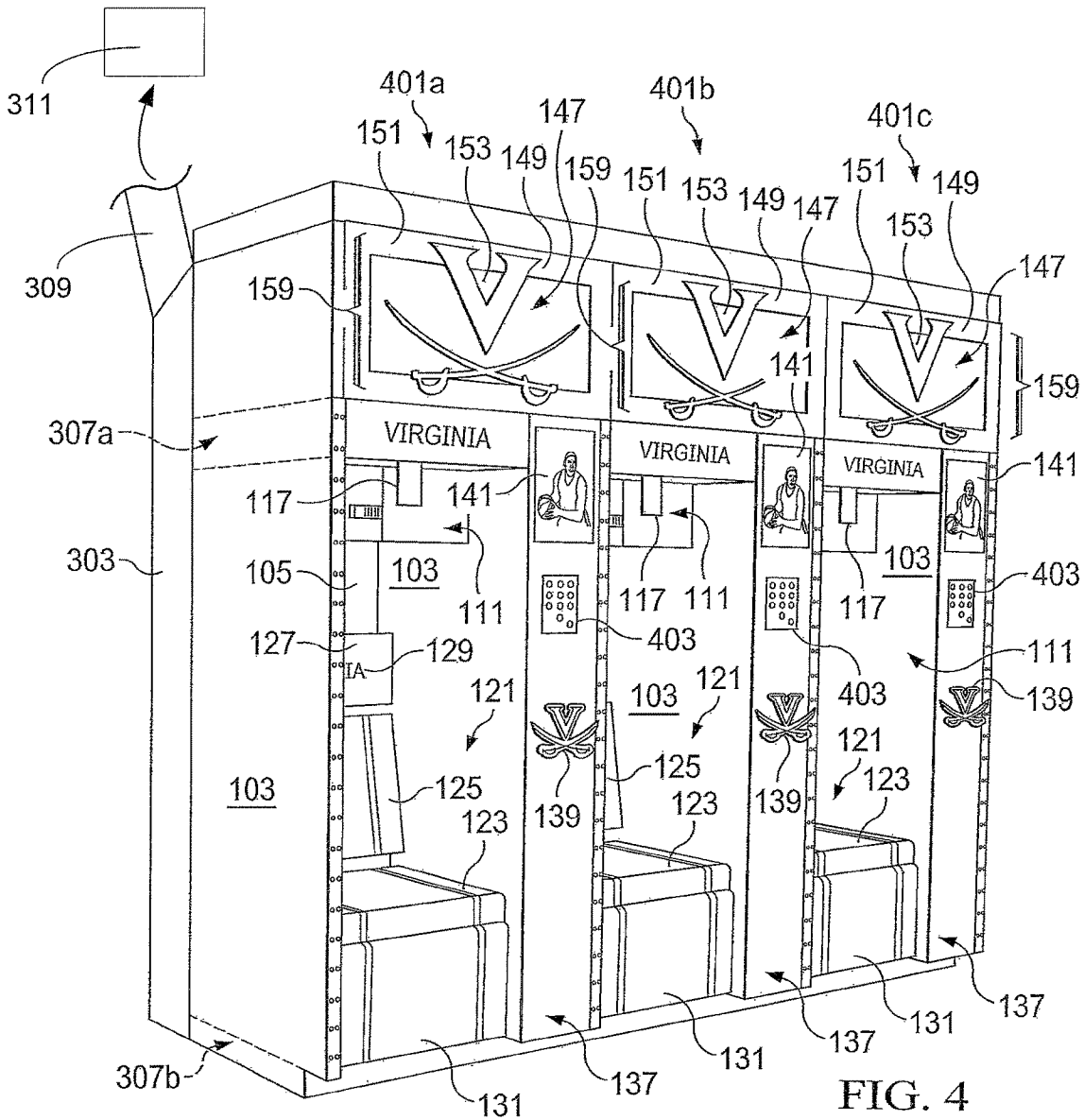
FIG. 4 is a perspective view of three lockers of FIGS. 1-3 connected in series with a control panel.

In other embodiments, chamber 307 is a chamber which is open through back wall 105 into a plenum 303 (see FIGS. 3B-3C), and may be a single chamber or split into multiple chambers depending on whether door 107 moves as a single panel or splits into multiple panels upon opening. In the embodiments seen in FIGS. 3B and 3C, door 107 passes into and through chambers 307 into plenum 303, and is stored as a single layer behind back wall 105. As shown in FIGS. 3C and 4, door chamber 307 can be split into two chambers, upper door chamber 307*a* and lower door chamber 307*b*. In other preferred embodiments with chambers 307 open to a plenum 303, door 107 may be wound into coiled or layered arrangements as described with regard to FIG. 3A.

Door 107 may operate in a variety of ways. Door 107 may operate manually such that a user supplies all the force and movement used to open the door. This preferably may be accomplished using a handle 109, or in other embodiments, may be accomplished with the use of a pull chain, strap, or other component which is linked mechanically to a door drive system housed within lockers 101*a*-101*d*, 301*a*-301*c*, 401*a*-401*c*.

Handle 109 is preferably a fabric strap or a rigid handle movably attached to door 107. Door 107 may have a slot or recess which houses handle 109 such that the handle is retracted into the recess in order that handle 109 does not catch on or otherwise contact components of lockers 101*a*-101*d*, 301*a*-301*c*, 401*a*-401*c* during the opening and closing of door 107. In other embodiments, handle 109 may be an opening, recess, or other formed feature in door 107 such that no additional strap or handle components are necessary. Alternatively, door 107 may not have any handle 109 and may instead open with the use of a chains, cables, gears, or other mechanical drive systems.

Door 107 may require manual opening as previously described, but may further contain an assisted-opening action such as a spring drive, hydraulic drive, or counterweight. In an assisted-opening design, such as designs wherein springs, hydraulics, or counterweights supply opening force to door 107, the system may be perfectly balanced such that no additional components are necessary to keep door 107 in an open or closed position. Alternatively, an assisted-opening system may not be perfectly balanced and may require some form of latching, clamping, braking, or other securing component to keep door 107 in an open or closed position.

Door 107 may be a self-opening design which uses some form of door-driving components, such as electrical, hydraulic, or pneumatic motors, connected to door 107 either directly or in combination with an arrangement of mechanical components such as straps, chains, gears, and fasteners.

Roll-up door 107 may be locked and unlocked, opened and closed, or otherwise controlled with control panel 403. (See FIG. 4). As depicted in the preferred embodiment of the present application, control panel 403 is an electronic keypad which, in combination with an electronic locking mechanism, locks roll-up door 107. Panel 403 may simply unlock door 107, or may actually control the opening of door 107 if the door is operated automatically. Control panel 403 is depicted as being mounted on the front of lockers 101*a*-101*d*, 301*a*-301*c*, 401*a*-401*c* on shoe storage compartment 137, but may be mounted at any exterior or interior point of lockers 101*a*-101*d*, 301*a*-301*c*, 401*a*-401*c*, depending on the desired design and configuration of the lockers. In some embodiments, control panel 403 may be an interactive touch screen that controls more advanced features of a locker, such as lighting, ventilation, or any electronic displays, in addition to the unlocking and opening of door 107.

In other embodiments, roll-up door 107 may not make use of control panel 403 at all. Door 107 may simply make use of a simple mechanical lock (not pictured) and be opened manually, or may open automatically and be unlocked and opened remotely with some combination of locker transceiver and remote transceiver. For example, door 107 could be opened remotely by a short range transmitter, such as a common radio wave garage door opener, or such as a Bluetooth-enabled device. Door 107 could also be connected to the internet and controlled wirelessly through the use of software on any internet-capable device, such as a smartphone. In an alternative embodiment, a series of lockers 101*a*-101*d*, 301*a*-301*c*, 401*a*-401*c* may not contain control panels 403, and doors 107 may all be remotely controlled from one common control panel which controls all the connected lockers together or individually.

The interior area of the lockers 101*a*-101*d*, 301*a*-301*c*, 401*a*-401*c* contains several features, including preferably and most notably a reclining seat 121 (see FIGS. 1-4). Each seat 121 generally comprises a bench 123, a seatback 125, a footrest 131, and a headrest 127 according to the preferred embodiment in the present application. Bench 123, seatback 125, footrest 131, and headrest 127 may be disposed and extended between sidewalls 103 or other sidewalls defined between sidewalls 103.

Seat 121 is operably moveable between an upright position and a reclined position. When seat 121 is in an upright position, bench 123 is in a generally horizontal position or orientation, and footrest 131, seatback 125, and headrest 127 are in a generally vertical position or orientation. Referring to FIGS. 1 and 2, locker 101*c* depicts a locker wherein seat 121 is in an upright position. When seat 121 is in a reclined position, bench 123 and footrest 131 are in a generally horizontal position, headrest 127 may be in a generally upright or generally reclined position depending on the design of lockers 101*a*-101*d*, 301*a*-301*c*, 401*a*-401*c*, and seatback 125 is in a generally reclined position and may be oriented at any degree between horizontal and vertical depending on the design of lockers 101*a*-101*d*, 301*a*-301*c*, 401*a*-401*c*. Referring to FIGS. 1 and 2, locker 101*b* is a locker wherein seat 121 is in a reclined position.

Seat 121 components bench 123, seatback 125, footrest 131, and headrest 127 are preferably padded and upholstered with an appropriate material, such as vinyl or leather or other textile material. The material and design choices for seat 121 will depend on the desired application and embodiment of lockers 101*a*-101*d*, 301*a*-301*c*, 401*a*-401*c*. Graphics may be present on components of seat 121. For example, referring to FIGS. 1-2, logo 129 is preferably present on headrest 127. As depicted, the logo is a school name, but in other embodiments may be a symbol, institution name, image, other graphic, or any combination thereof. Logo 129 may be an embroidered logo, a printed logo, an embedded feature, or a separate piece which is removably or permanently attached to headrest 127. Logo 129 may also be present on other components of seat 121 in addition to or instead of headrest 127.

Seat 121 contains some form of recliner operation assembly. The operation assembly comprises various combinations of operating components such as hinges, brackets, fasteners, linkages, levers, bearings, slides, pivots, springs, or pistons. The assembly operates and controls the reclining of seat 121 and attaches the seat to lockers 101*a*-101*d*, 301*a*-301*c*, 401*a*-401*c*. According to the preferred embodiment of the present application, the operation assembly is at least partially housed in and concealed by compartments of lockers 101*a*-101*d*, 301*a*-301*c*, 401*a*-401*c* such as lower compartment 133 (see FIGS. 1-2). The operation assembly may also be concealed by other locker features such as seat 121 instead of or in addition to lower compartment 133.

For seat 121 to be moved from an upright position into a reclined position, some force must be applied to the recliner operation assembly. This force may be supplied from a user, such as by applying or shifting body weight or other force, or may be supplied from components within the operation assembly such as springs, hydraulic pistons, pneumatic cylinders, and/or electric motors. Locker 101, 301, 401 may further contain some form of recliner release such as a lever, switch, handle, strap, or button, and may operate mechanically or electrically, alone or in combination with motion-arresting components, such as latches, brakes, pins, or magnets, which prevent the reclining of seat 121 until a user operates the recliner release.

Parts of seat 121 such as headrest 127 and seatback 125 may be easily removable or interchangeable. Seatback 125 may be made of multiple portions, such as an upper and lower portion, or may be a single portion. Seatback 125, whether a single portion or multiple portions, may be hinged such that the seatback portions may be moved about their respective hinges and open the seatback to allow a user to store and access equipment behind the seat. Parts of seat 121 such as headrest 127, seatback 125, and bench 123 may be ventilated and connected through lockers 101*a*-101*d*, 301*a*-301*c*, 401*a*-401*c* to plenum 303 such that air flows through seat 121 to a user. Airflow to seat 121 may be warm or cool air and may be used to cool or warm a person sitting in seat 121. Seat 121 may also be heated or cooled with other components, such as electrical heating elements, used alone or in combination with ventilation.

The interior area of lockers 101*a*-101*d*, 301*a*-301*c*, 401*a*-401*c* further contains a lower compartment 133 (see FIGS. 1-2). In the preferred embodiment according to the present application, compartment 133 serves as a housing for the recliner operational assembly for seat 121. Compartment 133 has a front panel 135 that conceals the assembly within the compartment. In an alternative embodiment, compartment 133 may contain chamber 307 for storage of roll-up door 107 instead of or in addition to housing and concealing components of a recliner operational assembly (not shown). In other embodiments, compartment 133 may be a functional footlocker wherein front panel 135 opens to allow access to the compartment, or wherein compartment 133 is actually a drawer that slides forward from underneath seat 121. Front panel 135 is depicted as containing apertures or vents through the panel. In the preferred embodiment according to the present application, these apertures or vents may be used in combination with the plenum 303 and other ducting to ventilate lockers 101*a*-101*d*, 301*a*-301*c*, 401*a*-401*c*.

The interior area of lockers 101*a*-101*d*, 301*a*-301*c*, 401*a*-401*c* further contains various features designed to help store and organize equipment and apparel. For example, in the preferred embodiment according to the present application, lockers 101*a*-101*d*, 301*a*-301*c*, 401*a*-401*c* contain a game day hook 117 (see FIGS. 1-5). Game day hook 117 preferably is removably mounted inside and at the top of the interior area of lockers 101*a*-101*d*, 301*a*-301*c*, 401*a*-401*c* in front of compartment 111. Game day hook 117 may be easily installed and removed such that hook 117 is only present on days when a user will be wearing game-day equipment Game-day equipment may be hung in locker 101, 301, 401 before a game or event, after which hook 117 is removed, until the next game or event. Lockers 101*a*-101*d*, 301*a*-301*c*, 401*a*-401*c* also contain interior equipment hooks 119. Referring to FIG. 1, lockers 101*a*-101*d*, 301*a*-301*c*, 401*a*-401*c* preferably contain a plurality of hooks 119 mounted on the front surface of back wall 105. Hooks 119 may be mounted elsewhere within the lockers, such as on locker sidewalls on the interior area and within compartments 111, 147. Hooks 117 and 119 may be made of various materials such as metal, wood, laminate, composite, or polymer, depending on the designs of lockers 101*a*-101*d*, 301*a*-301*c*, 401*a*-401*c* and the type of equipment that will be stored on hooks 117, 119.

To the side of the interior area, lockers 101*a*-101*d*, 301*a*-301*c*, 401*a*-401*c* preferably contain shoe storage compartment 137. Referring now to FIG. 5, shoe-storage compartment 137 includes a pair of spaced-apart, opposed or opposing front and rear end walls 501, which are connected at the top and bottom. Heavy-duty drawer slides 503 may be mounted at the top and bottom of end walls 501 and are secured to the interior of sidewalls 103 to permit compartment 137 to slide or move between extended (see FIG. 5) and retracted positions (as shown in FIGS. 3A-C and 4). Slides 503 may be located elsewhere along the vertical dimension of compartment 137, as well. Compartment 137 may vary in height, width, and depth but should be large enough in all dimensions to accommodate at least one pair of shoes and preferably two or more pairs. Compartment 137 may be provided with illumination in the form of LED lights or other illumination sources. Such illumination may be controlled by switches that turn it on or off as compartment 137 is opened and closed.

As shown in FIG. 5, a plurality of pairs of generally opposed or opposing projections 505 are secured to end walls 501 in a slightly staggered fashion. Projections 505 serve to temporarily secure and support shoes in a storage position within compartment 137. In the preferred embodiment according to the present application, projections 505 are designed to support shoes from underneath, but in other embodiments may support footwear by fitting inside the footwear and holding it either upright or upside down. Projections 505 preferably are formed of sheet stainless steel, bent at an angle, with a vertical portion riveted, screwed, or otherwise fastened to end walls 501. Projections 505 may be shorter or longer than illustrated to accommodate different sizes or types of shoes (e.g. provided with notches for "flip flops," or shaped differently to accommodate boots or other high-topped shoes) and to accommodate gloves (with or without individual finger projections). Projections 505 may be provided with electric resistance or other heating elements to assist drying of shoes or other equipment. Projections 505 may be provided with anti-odor, anti-fungal, or anti-bacterial coatings or inserts to prevent odor or infections. Projections 505 may also be adjustable as to length or angle via, hinges and other mechanisms so that they can be customized to accommodate different types of shoes, gloves, and other equipment. Projections 505 may also be hollow and connected to a forced-air ventilation system to provide additional air circulation within and about any footwear or equipment contained in compartment 137.

At least one side of compartment 137 must be open-faced when compartment 137 is extended from lockers 101*a*-101*d*, 301*a*-301*c*, 401*a*-401*c* to permit access to projections 505. A perforated rear wall 507 may extend between end walls 501 to add strength to enclosure or compartment 137. The perforations permit air circulation to allow stored shoes to dry. Air may be supplied to compartment 137 by a forced-air ventilation system (either wholly or partially self-contained or coupled to building HVAC). Such ventilation may include anti-odor, anti-fungal, or anti-bacterial treatments. A removable debris tray 509 may be disposed at the bottom of enclosure 137 to catch mud, grass, and other debris from shoes stored in compartment 137. Tray 509 may be removed and debris emptied and replaced.

In operation, the locker user pulls shoe compartment 137 from the retracted position into the extended position by using handle 139. The locker user places recently worn, dirty, and sweaty or otherwise wet shoes onto projections 505. Compartment 137 then may be closed, and any shoes or equipment contained within compartment 137 will dry. Any dried mud or grass or other debris falling from shoes may land on tray 509, which may be removed for disposal of the debris. Components of shoe storage compartment 137 may be made of various materials such as metal, wood, laminate, composite, or polymer, depending on the designs of locker lockers 101*a*-101*d*, 301*a*-301*c*, 401*a*-401*c*. In the preferred embodiment according to the present application, compartment 137 and its components are primarily made of stainless steel.

In the preferred embodiment according to the present application, compartment 137 is shown as being to the right of the reclining seat 121 and interior area as seen from the front of lockers 101*a*-101*d*, 301*a*-301*c*, 401*a*-401*c*, but could be mounted to the left instead. Other embodiments may have multiple compartments 137, located on either or both sides of seat 121. In the preferred embodiment, compartment 137 extends from the base of lockers 101*a*-101*d*, 301*a*-301*c*, 401*a*-401*c* to the bottom edge of overhead compartment 147, but in other embodiments could be shorter to allow more usable space for the rest of the locker. For example, in other embodiments compartment 137 may extend upward only enough such that an arm rest may be mounted above compartment 137 for a user in seat 121. Compartment 137 may also be split into multiple pieces. For example, an alternative locker embodiment may have one enclosure for compartment 137 but contain two separate shoe storage drawers within the enclosure, one mounted above the other. Alternatively, a locker may not contain shoe storage compartment 137 at all, and may either be more compact as a result or provide a wider seat 121.

Above the interior area, lockers 101*a*-101*d*, 301*a*-301*c*, 401*a*-401*c* contain an upper panel 143. In the preferred embodiment according to the present application, panel 143 is located in front of door chamber 307 and serves to conceal door 107 when the door is in an open position. Panel 143 also serves to conceal any portion of guiding components 305 and any door operational components, such as a drive system or tension system, which are located within chamber 307.

Panel 143 preferably is removably coupled to lockers 101*a*-101*d*, 301*a*-301*c*, 401*a*-401*c* so that panel 143 may be easily removed or changed. The removable panel gives maintenance personnel easy access behind panel 143 to maintain or replace any components held behind the panel. In other embodiments, panel 143 is hinged along an upper or lower edge such that it is not completely removable but still allows easy access behind the panel, or is fixed to a locker such that maintenance personnel would need to undue fasteners such as screws or bolts to access components behind the panel.

In the preferred embodiment according to the present application, panel 143 contains a logo 145 (see FIGS. 1-2) laser etched into the front surface of panel 143 and filled with paint, ink, or other substances. This logo may be in any form, including symbols, written words, or other visual depictions.

Above panel 143 and at the top of the lockers, lockers 101*a*-101*d*, 301*a*-301*c*, 401*a*-401*c* contain an overhead compartment 147. This compartment is defined by the sidewalls 103 of lockers 101*a*-101*d*, 301*a*-301*c*, 401*a*-401*c* and shelves or other horizontally extending surfaces or platforms (see FIGS. 1-2). An overhead door 149 is attached at the front of compartment 147 and is hinged along a top edge so that door 149 may be opened upwards to allow access to the contents of compartment 147.

Compartment 147 preferably contains a door opening mechanism (not shown) wherein components such as springs, hydraulic pistons, levers, pivots, other components, or any combination thereof are used to apply an opening force to overhead door 149. Depending on the magnitude of the opening force supplied to door 149, and on the design of the opening mechanism, overhead door 149 may stay closed when put in a closed position and stay open when placed in an open position without the use of a releasable fastener, or door 149 may use some type of releasable fastener like a latch or magnet to hold door 149 in a closed position.

In other embodiments, compartment 147 may not contain any components which assist in the opening of door 149, and may contain other features or components which hold door 149 open when door 149 is put in an open position.

Overhead door 149 preferably comprises a border panel 151 and a lighted panel 153. Lighted panel 153 may have its own backlighting attached to door 149 behind panel 153, or panel 153 may simply be a translucent or transparent panel that is illuminated by lights within compartment 147. In other embodiments, panel 153 may not be lighted and instead may be an opaque material such as wood, metal, or laminate. In the preferred embodiment, a logo 159 is attached to border panel 151 in front of lighted panel 153. Other embodiments, overhead door 149 may not contain a logo 159.

Overhead compartment 147 preferably contains an extending and retracting shoe shelf 155 (see FIGS. 1-2). Shelf 155 slides forward partially out of compartment 147 and pivots down toward a user so that a user has easier access to shoes or other equipment or items stored on shelf 155. Compartment 147 also preferably contains ventilation apertures or a grille 157 through back wall 105 to allow ventilation created by fans or an HVAC system through plenum 303 to circulate air in compartment 147. This circulation in overhead compartment 147 helps dry or keep fresh any shoes or other gear and equipment kept in overhead compartment 147.

Lockers 101*a*-101*d*, 301*a*-301*c*, 401*a*-401*c* preferably contain additional features on the exterior of the lockers. Referring to FIGS. 1-4, display panel 141 is present on the front of the lockers. In the preferred embodiment according to the present application, display panel 141 is located on the front of shoe storage compartment 137. In other embodiments, display panel 141 may be located at any exterior point on a locker.

Display panel 141 is shown as a simple backlit panel with an image, but display panel 141 should be understood to include any kind of display. For example, display panel 141 may be a programmable electronic display wherein the display is controlled individually and in series with display panels 141 on other lockers 101*a*-101*d*, 301*a*-301*c*, 401*a*-401*c*. Display panel 141 may be an interactive programmable electronic display such as a touch-screen display, and may function to control various features and components of lockers 101*a*-101*d*, 301*a*-301*c*, 401*a*-401*c* such as lighting, ventilation, and the opening and closing, and the locking and unlocking of doors 107, 149, 113 and compartment 137. In embodiments wherein display panel 141 is a touch-screen display, control panel 403 may have limited function or may be excluded altogether.

In some embodiments, a programmable electronic display (not pictured) may be mounted on or above door 149 in place of or in addition to lighted panel 153 and logo 159. In such other embodiments, display panel 141 or control panel 403 may control the programmable display on door 149. Alternatively, a programmable display on or above door 149 may be controlled, individually and in series with other overhead displays or display panels 141 on the same or other lockers, by an external computer or other electronic device.

Lockers 101*a*-101*d*, 301*a*-301*c*, 401*a*-401*c* contain various features and components. It should be understood that certain features, such as upper panel 143, or images displayed on display panel 141 or an overhead display, are easily interchangeable. For example, displays and logos in lockers 101*a*-101*d*, 301*a*-301*c*, 401*a*-401*c* may be changed for important events such as tournaments, playoffs, championships, and bowl games. Furthermore, displayed images or logos which are specific to a certain user, such as a specific player on a team, must be changed in certain normal circumstances, such as when a player leaves a team and a new player begins using the locker. It should also be understood that any features of lockers 101*a*-101*d*, 301*a*-301*c*, 401*a*-401*c* such as any handles, locks, levers, or latches (for example: hooks 117 and 119, handle 139) may be customized to be in the shape of any logos, promotional indicia, or other specific shapes a user or organization prefers.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered, modified and/or combined, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker, comprising:

a main storage area defined by a pair of upstanding side walls and a backwall;

a shoe storage area defined by one or more interior side walls;

a sliding shoe storage unit disposed within the shoe storage area, the shoe storage unit comprising:

a top drawer slide member;

a bottom drawer slide member;

a rear end wall extending between the top drawer slide member and the bottom drawer slide member;

a front end wall extending between the top drawer slide member and the bottom drawer slide member;

a rear wall;

the rear wall extending fully between the front end wall and the rear end wall, the rear wall being rigidly attached to the front end wall and the rear end wall, such that the rear wall does not move relative to either the front end wall or of the rear end wall; and a plurality of projections coupled to the rear end wall and the front end wall, each projection being planar over the length thereof, such that each projection is flat and straight along the entire length thereof and flat and straight along the entire width thereof and there are no additions to the edge of the projection extending beyond its planar length and width, so as to support shoes, each projection configured for attachment to either the rear end wall or the front end wall, each projection being formed from a piece of material that is separate from the rear end wall and the front end wall, each projection does not extend from one end wall to the other such that there is a gap between the opposing projections;

wherein each of the plurality of projections comprise a planar elongated portion with a length and a width sufficiently configured to support one or more of the shoes on a top surface of the planar elongated portion, and the planar elongated portion being inclined upward relative to the respective attachment to either the rear end wall or the front end wall; and wherein the sliding shoe storage unit is carried by at least one of the top drawer slide member, the bottom drawer slide member, and the rear wall, such that the sliding shoe storage unit may slide between a retracted position in which the sliding shoe storage unit is enclosed within the shoe storage area, and an open position in which the sliding shoe storage unit is extended forward of the shoe storage area; and a plenum connected to an HVAC system for circulating air through the main storage area and the shoe storage area;

wherein the rear wall is at least partially perforated with an arranged pattern of multiple apertures to allow air flow between the shoe storage area and the main storage area.

2. The locker according to claim 1, wherein the front end wall encloses the shoe storage unit within the shoe storage area when the shoe storage unit is in the retracted position.

3. The locker according to claim 1, wherein the plenum is adjacent the back wall and is in fluid communication with the main storage area.

4. The locker according to claim 3, further comprising:

duct work for connecting the plenum to the HVAC system.

5. The locker according to claim 4, wherein the HVAC system is dedicated to multiple lockers.

6. The locker according to claim 4, wherein the HVAC system is an HVAC system for a structure in which the locker is located.

7. The locker according to claim 1, further comprising:

duct work for exhausting air from the locker to a remote location.

8. The locker according to claim 1, further comprising:

at least one grille formed in the back wall through which air may be circulated.

9. The locker according to claim 1, further comprising:

a removable tray disposed within the sliding shoe storage unit.

10. The locker according to claim 1, wherein the drawer slide system is a self-closing soft-close drawer slide system.

* * * * *